US007153129B2

(12) United States Patent
Bussman et al.

(10) Patent No.: US 7,153,129 B2
(45) **Date of Patent: *Dec. 26, 2006**

(54) REMOTE STAGED FURNACE BURNER CONFIGURATIONS AND METHODS

(75) Inventors: Wesley R. Bussman, Tulsa, OK (US); Richard T. Waibel, Broken Arrow, OK (US); Charles E. Baukal, Jr., Tulsa, OK (US); Roberto Ruiz, Tulsa, OK (US); I-Ping Chung, Tulsa, OK (US); Sellamuthu G. Chellappan, Houston, TX (US)

(73) Assignee: John Zink Company, LLC, Tulsa, OK (US)

( * ) Notice: Subject to any disclaimer, the term of this patent is extended or adjusted under 35 U.S.C. 154(b) by 144 days.

This patent is subject to a terminal disclaimer.

(21) Appl. No.: 10/807,977

(22) Filed: Mar. 24, 2004

(65) Prior Publication Data

US 2005/0158684 A1 Jul. 21, 2005

Related U.S. Application Data

(63) Continuation-in-part of application No. 10/758,642, filed on Jan. 15, 2004, now Pat. No. 7,025,590.

(51) Int. Cl.
*F23D 14/12* (2006.01)

(52) U.S. Cl. ..... 431/348

(58) Field of Classification Search ..... 431/8–10, 431/174–180, 348–353
See application file for complete search history.

(56) References Cited

U.S. PATENT DOCUMENTS 4,496,306 A 1/1985 Okigami et al.
4,652,232 A 3/1987 Schwartz et al.
4,661,685 A 4/1987 Contri
D289,600 S 5/1987 Thomas
D289,963 S 5/1987 Thomas
4,663,849 A 5/1987 Nickelson
4,664,617 A 5/1987 Schwartz et al.
D290,215 S 6/1987 Sonnentag et al.
D290,218 S 6/1987 Thomas
4,673,798 A 6/1987 Contri et al.
D290,889 S 7/1987 Steinkamp
4,683,369 A 7/1987 Rieckman et al.
4,686,352 A 8/1987 Nawrot et al.
4,702,691 A 10/1987 Ogden
4,737,100 A 4/1988 Schnell et al.
4,781,578 A 11/1988 Napier
4,788,918 A 12/1988 Keller
4,798,150 A 1/1989 Pressnall et al.
4,838,184 A 6/1989 Young et al.
4,870,910 A 10/1989 Wright et al.
4,900,244 A 2/1990 Keller et al.
4,901,652 A 2/1990 Pressnall et al.
4,902,484 A 2/1990 Martin et al.
4,922,838 A 5/1990 Keller et al.

(Continued)

FOREIGN PATENT DOCUMENTS

CA 2076705 9/1993

(Continued)

*Primary Examiner*—S. Gravini
(74) *Attorney, Agent, or Firm*—McAfee & Taft

(57) ABSTRACT

A remote staged furnace burner configuration includes placement of secondary fuel gas nozzles remote from burners. This configuration brings about an increased mixing of secondary fuel with furnace fuel gases. As a result, the temperature of the burning fuel gas is lowered and $NO_X$ formation is reduced.

22 Claims, 16 Drawing Sheets

U.S. PATENT DOCUMENTS

| | | | | |
|---|---|---|---|---|
| 4,952,137 | A | | 8/1990 | Schwartz et al. |
| 4,975,042 | A | | 12/1990 | Schwartz et al. |
| 5,098,282 | A | | 3/1992 | Schwartz et al. |
| 5,154,596 | A | | 10/1992 | Schwartz et al. |
| 5,154,735 | A | | 10/1992 | Dinsmore et al. |
| 5,180,302 | A | | 1/1993 | Schwartz et al. |
| 5,195,844 | A | | 3/1993 | Goans |
| 5,195,884 | A | | 3/1993 | Schwartz et al. |
| 5,238,395 | A | | 8/1993 | Schwartz et al. |
| 5,275,552 | A | | 1/1994 | Schwartz et al. |
| 5,345,771 | A | | 9/1994 | Dinsmore |
| 5,573,391 | A | | 11/1996 | Benson et al. |
| 5,688,115 | A | * | 11/1997 | Johnson ..... 431/9 |
| 5,718,573 | A | * | 2/1998 | Knight et al. ..... 431/354 |
| 5,813,849 | A | | 9/1998 | Schwartz et al. |
| 5,846,068 | A | | 12/1998 | Schwartz et al. |
| 5,951,741 | A | | 9/1999 | Dahl et al. |
| 6,000,930 | A | | 12/1999 | Kelly et al. |
| 6,062,848 | A | * | 5/2000 | Lifshits ..... 431/285 |
| 6,231,334 | B1 | | 5/2001 | Bussman et al. |
| 6,347,935 | B1 | | 2/2002 | Schindler et al. |
| 6,379,146 | B1 | | 4/2002 | Zink et al. |
| 6,383,461 | B1 | | 5/2002 | Lang |
| 6,383,462 | B1 | | 5/2002 | Lang |
| 6,422,858 | B1 | | 7/2002 | Chung et al. |
| 6,464,492 | B1 | | 10/2002 | Guarco et al. |
| 6,478,239 | B1 | | 11/2002 | Chung et al. |
| 6,486,375 | B1 | | 11/2002 | Lenhart et al. |
| 6,524,098 | B1 | | 2/2003 | Tsirulnikov et al. |
| 6,565,361 | B1 | | 5/2003 | Jones et al. |
| 6,607,376 | B1 | | 8/2003 | Poe |
| 6,616,442 | B1 | | 9/2003 | Venizelos et al. |
| 6,632,083 | B1 | | 10/2003 | Bussman et al. |
| 6,634,881 | B1 | | 10/2003 | Bussman et al. |
| 2002/0076668 | A1 | | 6/2002 | Venizelos et al. |

FOREIGN PATENT DOCUMENTS

| | | |
|---|---|---|
| EP | 0 562 710 A2 | 9/1993 |
| EP | 1 108 952 A2 | 6/2001 |
| JP | 6-18011 | 1/1994 |
| JP | 2633452 | 7/1997 |

* cited by examiner

REMOTE STAGED FURNACE BURNER CONFIGURATIONS AND METHODS

This application is a Continuation-In-Part of application Ser. No. 10/758,642 filed on Jan. 15, 2004 now U.S. Pat. No. 7,025,590.

BACKGROUND OF THE INVENTION

1. Field of the Invention

The present invention relates to remote staged furnace burner configurations, and more particularly, to the placement of secondary fuel gas nozzles separate and remote from the burners resulting in lower $NO_X$ production.

2. Description of the Prior Art

Gas burner furnaces are well known and have been used in reforming and cracking operations and the like for many years. Radiant wall burner furnaces generally include radiant wall burners having central fuel gas-air mixture burner tubes surrounded by annular refractory tiles which are adapted for insertion into openings in the furnace wall. The burner nozzles discharge and burn fuel gas-air mixtures in directions generally parallel and adjacent to the internal faces of the refractory tiles. The combustion of the fuel gas-air mixtures causes the faces of the burner tiles to radiate heat, e.g., to process tubes, and undesirable flame impingement on the process tubes is thereby avoided. Radiant wall burners are typically installed in several rows along a furnace wall. This type of configuration is usually designed to provide uniform heat input to the process tubes from the wall area comprising the radiant wall burner matrix.

Vertical cylindrical furnaces, cabin furnaces and other similar furnaces such as boilers are also well known. Vertical cylindrical furnaces generally include an array of burners on the floor of the furnace that discharge and burn fuel gas-air mixtures vertically. Process tubes are positioned vertically around the burners and adjacent to the cylindrical wall of the furnace whereby heat from the burning fuel gas-air mixtures radiates to the process tubes.

Cabin furnaces and other similar furnaces generally include an array of two or more burners on the rectangular floor of the furnace that discharge and burn fuel gas-air mixtures vertically. Horizontal process tubes are arranged on opposite walls of the furnace which are parallel to the burner array. Additional process tubes can also be arranged adjacent to the top of the furnace. Heat from the burning fuel gas-air mixtures radiates to the process tubes.

More stringent environmental emission standards are continuously being imposed by governmental authorities which limit the quantities of gaseous pollutants such as oxides of nitrogen ($NO_X$) that are introduced into the atmosphere. Such standards have led to the development of staged or secondary fuel burner apparatus and methods wherein all of the air and some of the fuel is burned in a first zone and the remaining fuel is burned in a second downstream zone. In such staged fuel burner apparatus and methods, an excess of air in the first zone functions as a diluent which lowers the temperature of the burning gases and thereby reduces the formation of $NO_X$. Desirably, furnace fuel gases function as a diluent to lower the temperature of the burning secondary fuel and thereby reduce the formation of $NO_X$.

Similarly, staged burner designs have also been developed wherein the burner combusts a primary fuel lean mixture of fuel gas and air and stage fuel risers discharge secondary fuel. The location of the secondary fuel risers can vary, depending on the manufacturer and type of burner, but they are typically located around and adjacent to the perimeter of the primary burner.

While the staged burners and furnace designs have been improved whereby combustion gases containing lower levels of $NO_X$ are produced, additional improvement is necessary. Thus, there are needs for improved methods of burning fuel gas and air using burners whereby fuel gases having lower $NO_X$ levels are produced.

SUMMARY OF THE INVENTION

Furnace burner configurations are provided utilizing one or more burners that burn lean primary fuel gas-air mixtures and one or one or more arrays of secondary fuel gas nozzles that burn secondary fuel gas located separate and remote from the one or more burners. Secondary fuel gas is introduced into the secondary fuel gas nozzles in an amount that constitutes a substantial portion of the total fuel provided to the combustion zone by the lean primary fuel gas-air mixtures and the secondary fuel gas. Preferably, the secondary fuel gas nozzles are positioned on the furnace wall or on the furnace floor, or both, and direct secondary fuel gas to various locations including a location on the opposite side of the combustion zone from the burners. As a result, $NO_X$ levels in the combustion gases leaving the furnace are substantially reduced.

In a preferred arrangement in a wall burner furnace, the furnace wall is at least substantially vertical and the radiant wall burners are approximately parallel and approximately evenly spaced in rows and columns, and the secondary fuel gas nozzles are positioned in a single row with each nozzle positioned directly below a radiant wall burner in the row above. In another preferred configuration, the radiant wall burners are approximately parallel with the burners approximately evenly spaced in rows and columns, and the secondary fuel gas nozzles are positioned below the radiant wall burners in an upper row and a lower row, wherein each nozzle of the upper row is directly below a burner in the row above and wherein each nozzle of the lower row is midway between the horizontal positions of the nozzles directly above it. In yet another preferred configuration, the radiant wall burners are offset halfway from one another in a staggered positioning, and the secondary fuel gas nozzles are positioned in a single or double row directly below the radiant wall burners with each nozzle positioned to continue the staggered positioning. In still another configuration, a first row of secondary fuel gas nozzles is located below all the radiant wall burners and a second row of secondary gas nozzles is located about midway up the rows of radiant wall burners. In other preferred arrangements, secondary fuel gas nozzles are also located on the furnace floor, and the furnace can include floor burners (also referred to as hearth burners) with or without secondary fuel gas nozzles on the floor. Preferably, the secondary fuel gas nozzles have tips with at least one fuel delivery orifice designed to eject fuel gas at an angle relative to the longitudinal axis of the nozzle. More preferably, the secondary fuel gas nozzles have multiple fuel delivery orifices.

In a preferred arrangement in a vertical cylindrical furnace having vertical process tubes, primary burners are positioned on the floor of the furnace that discharge and burn fuel gas lean-air mixtures vertically. One or an array of secondary fuel gas nozzles are also positioned on the floor of the furnace, on the walls of the furnace, or both, whereby the secondary fuel gas nozzles are separate and remote from the primary burners. The secondary fuel is directed by the secondary fuel gas nozzle or nozzles to mix with fuel gases in the furnace and then combust with excess air to thereby lower the temperature of the burning fuel gas and reduce the formation of $NO_X$.

In a preferred arrangement in a cabin furnace and other similar furnaces having horizontal process tubes, primary burners are positioned on the floor of the furnace that discharge and burn fuel gas lean-air mixtures vertically. One or an array of secondary fuel gas nozzles are also positioned on the floor of the furnace, on the walls of the furnace, or both, whereby the secondary fuel gas nozzles are separate and remote from the primary burners. The secondary fuel is directed by the secondary fuel gas nozzle or nozzles to first mix with fuel gases in the furnace and then combust with excess air to thereby lower the temperature of the burning fuel gas and reduce the formation of $NO_X$.

Other features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIGS. 5A–5F illustrate remote staging configurations in a radiant wall furnace that include additional secondary fuel gas discharge nozzles on the furnace floor with and without floor burners.

FIGS. 6A–6C illustrate preferred remote staging configurations in a vertical cylindrical furnace.

DESCRIPTION OF PREFERRED EMBODIMENTS

A preferred radiant wall furnace burner configuration of this invention utilizes rows of multiple radiant wall burners that include annular refractory tiles and burn fuel gas lean air mixtures connected to a wall of the furnace in a regular spacing and an array of secondary fuel gas nozzles located separate and remote from the radiant wall burners with means for introducing secondary fuel gas into the secondary fuel gas nozzles and wherein the secondary fuel gas constitutes a substantial portion of the total fuel provided to the combustion zone by the fuel gas-air mixtures and the secondary fuel gas. Preferably, the secondary fuel gas nozzles are positioned on the furnace wall adjacent to the rows of radiant wall burners or on the furnace floor, or both, and direct secondary fuel gas to various locations including a location on the opposite side of the combustion zone from the radiant wall burners. As a result, $NO_X$ levels in the combustion gases leaving the furnace are reduced.

Figure 1:
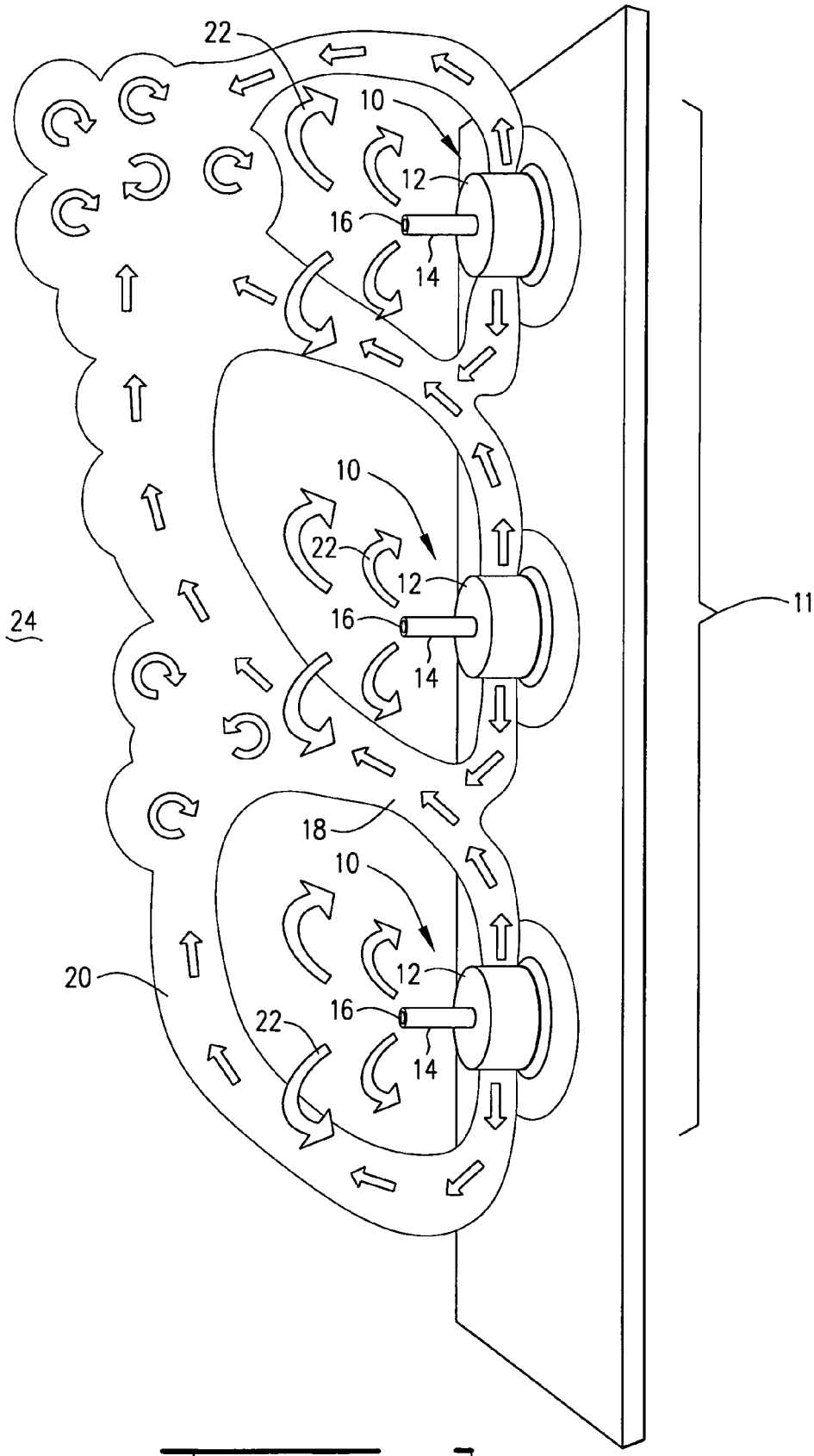
FIG. 1 illustrates the gas flow pattern in a radiant wall furnace using conventional staging with secondary fuel gas in the center of each burner.

Referring now to the drawings, FIG. 1 depicts a traditional burner column 11 of staged fuel radiant wall burners 10. The staged fuel radiant wall burners 10 consist of radiant wall burner tips 12 which are provided with a fuel gas lean mixture of primary fuel gas and air. Secondary fuel gas risers 14 supply the secondary fuel gas tips 16 thereof with fuel gas. The location of the secondary fuel gas tips 16 is typically in the centers of the radiant wall burner tips 12 as shown in FIG. 1, or around the perimeters of the radiant wall burner tips 12. As shown in FIG. 1, the fuel gas-air streams exiting the burner tips 12 form barriers 18 and 20 and encapsulate or surround the secondary fuel gas 22. The fuel gas-air barriers 18 and 20 around the secondary fuel gas 22 prevent sufficient entrainment of fuel gas 24 resulting in increased $NO_X$ emissions.

Figure 2:
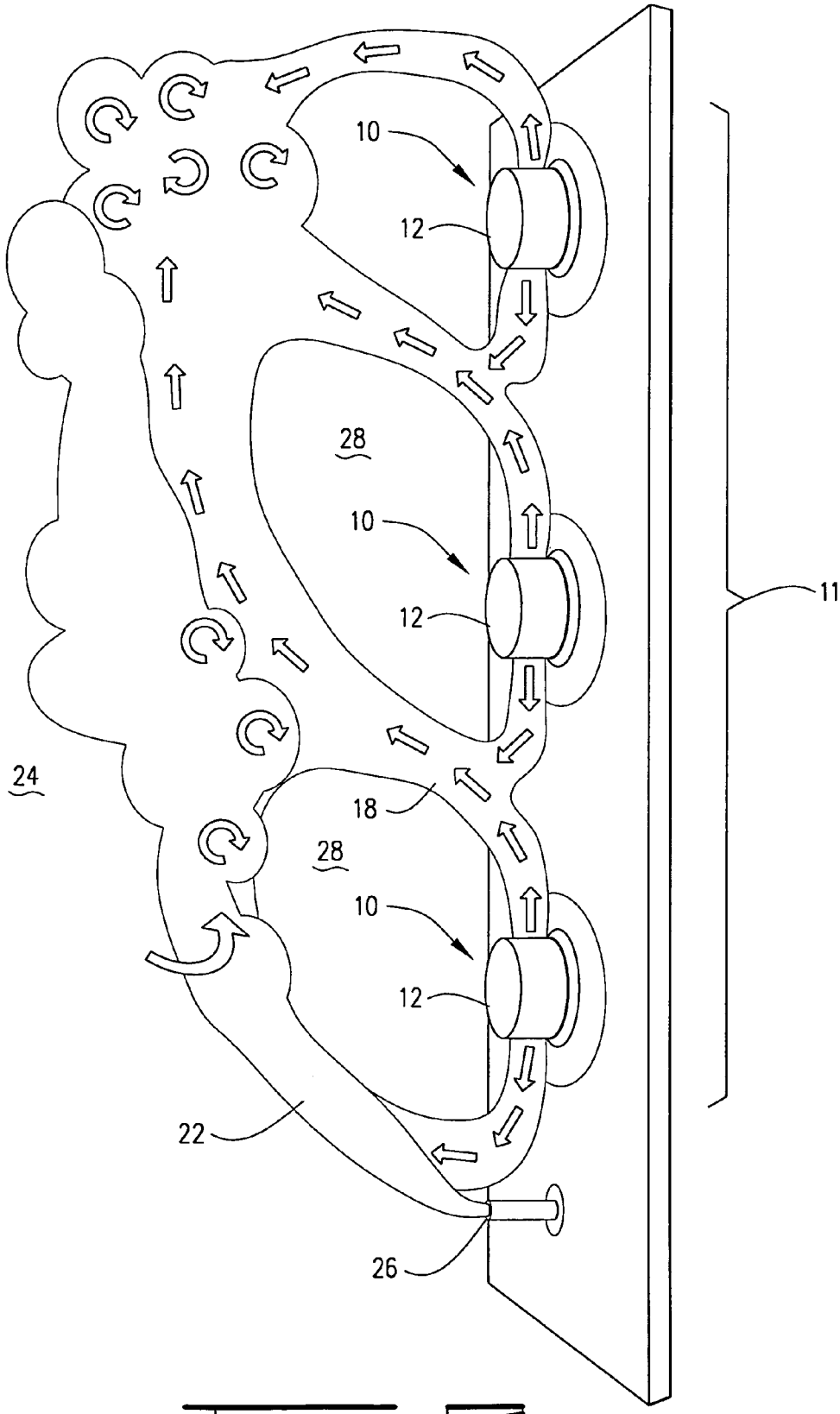
FIG. 2 illustrates the gas flow pattern of the present invention in a radiant wall furnace with remote staging of fuel gas.

In the remote staged fuel technique of the present invention, the secondary fuel gas from or adjacent each radiant wall burner 10 is eliminated. Instead, the secondary fuel gas is injected into the furnace at a remote location. As shown in FIG. 2, by moving the secondary fuel gas to a remote secondary fuel gas nozzle 26 located, for example, below the burner column 11, the secondary fuel gas 22 is able to mix with the furnace fuel gases 24 prior to mixing with the fuel gas-air mixture 18 in the combustion zone 28. It has been found that by using one or more remote secondary fuel gas nozzles 26 positioned at remote locations and providing secondary fuel gas patterns, reduced $NO_X$ emissions are achieved as well as improved flame quality compared to state-of-the-art radiant wall burner designs.

Figure 3:
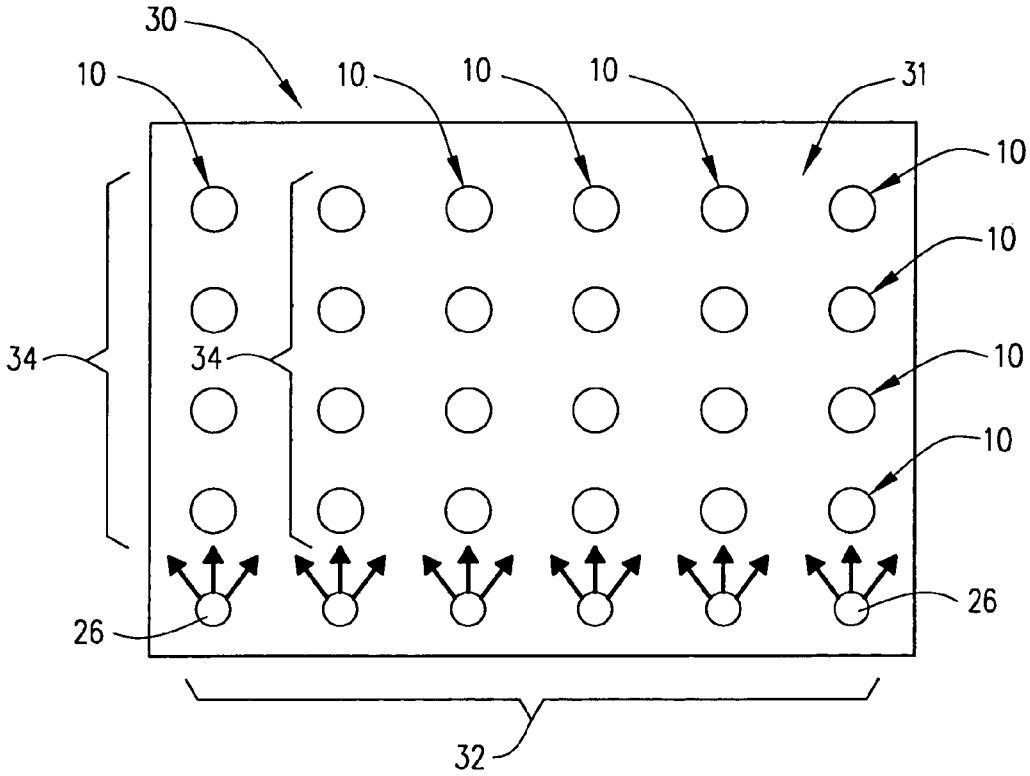
FIG. 3 is a preferred remote staging burner configuration on the wall of a radiant wall furnace.

Referring to FIG. 3, an improved radiant wall furnace burner configuration of this invention is illustrated and generally designated by the numeral 30. Rows 32 of multiple radiant wall burners 10 are inserted in a wall 31 of the furnace. The radiant wall burners 10 discharge fuel gas-air mixtures in radial directions across the face of the furnace wall 31. Radiant heat from the wall, as well as thermal radiation from the hot gases, is transferred, for example, to process tubes or other process equipment designed for heat transfer.

Each radiant wall burner 10 is provided a mixture of primary fuel gas and air wherein the flow rate of air is greater than stoichiometry relative to the primary gas. Preferably the rate of air is in the range of from about 105% to about 120% of the stoichiometric flow rate required to completely combust the primary and secondary fuel gas. Secondary fuel gas is discharged into the furnace by way of secondary fuel gas nozzles 26. The burner configuration of FIG. 3 shows the secondary fuel gas nozzles 26 arranged in a row 32 with each secondary fuel gas nozzle positioned below a column 34 of radiant wall burners. The secondary fuel gas nozzles are made to discharge fuel gas in a direction generally toward the radiant wall burners as will be explained in detail below.

Figure 4A:
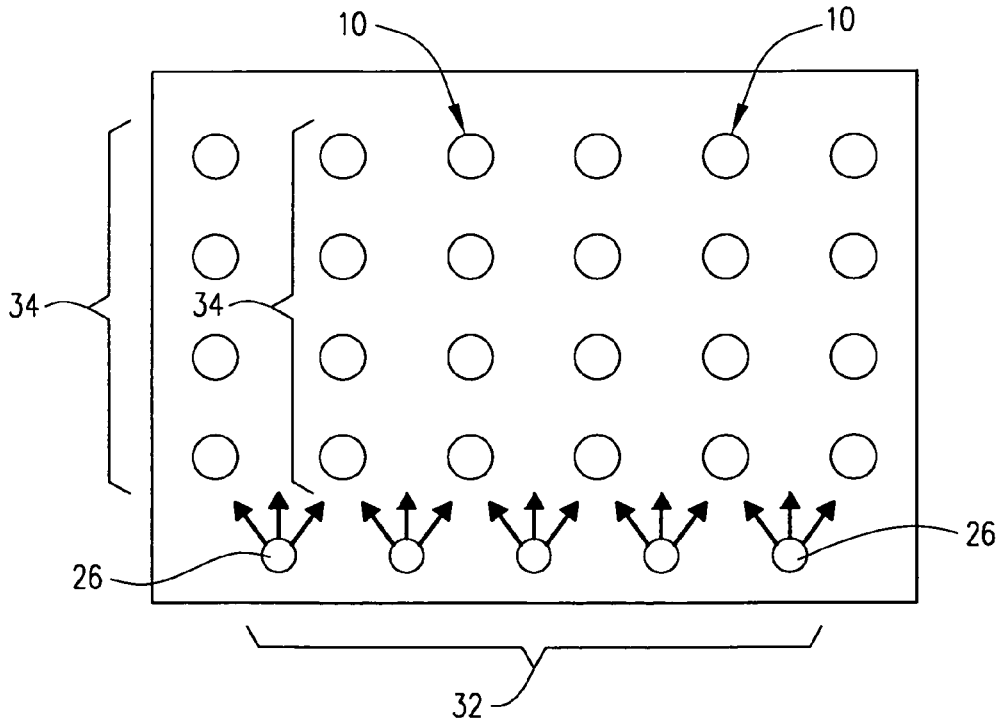
FIGS. 4A–4D illustrate other preferred remote staging configurations on the wall of a radiant wall furnace.
Figure 4B:
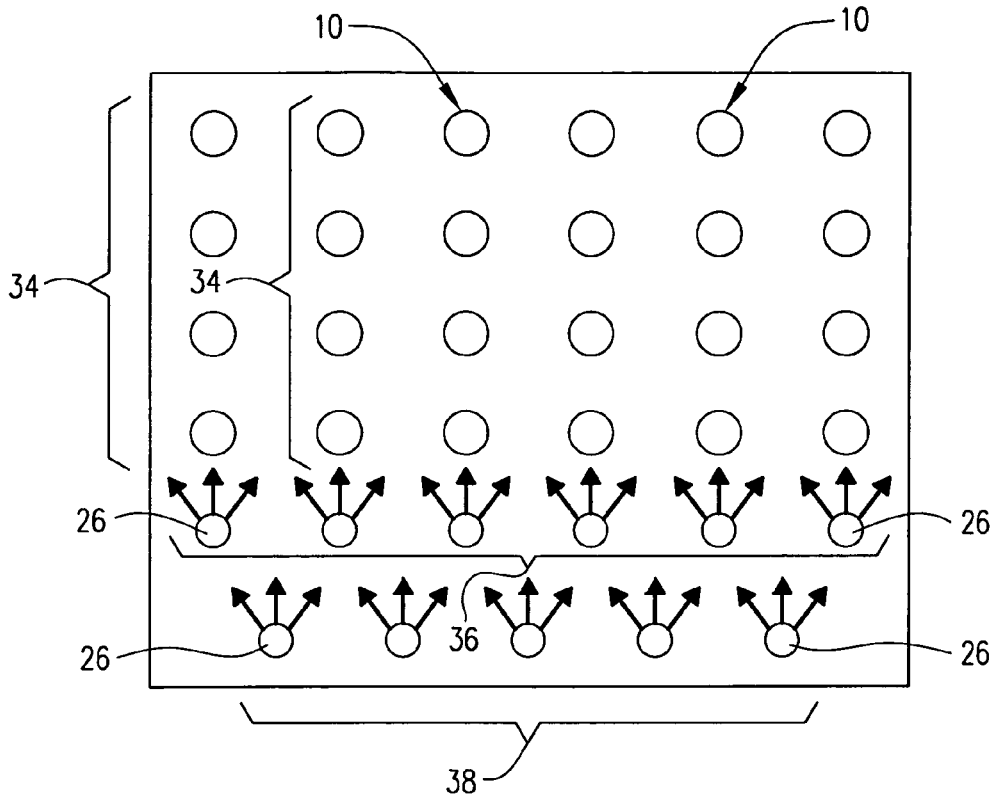
Figure 4C:
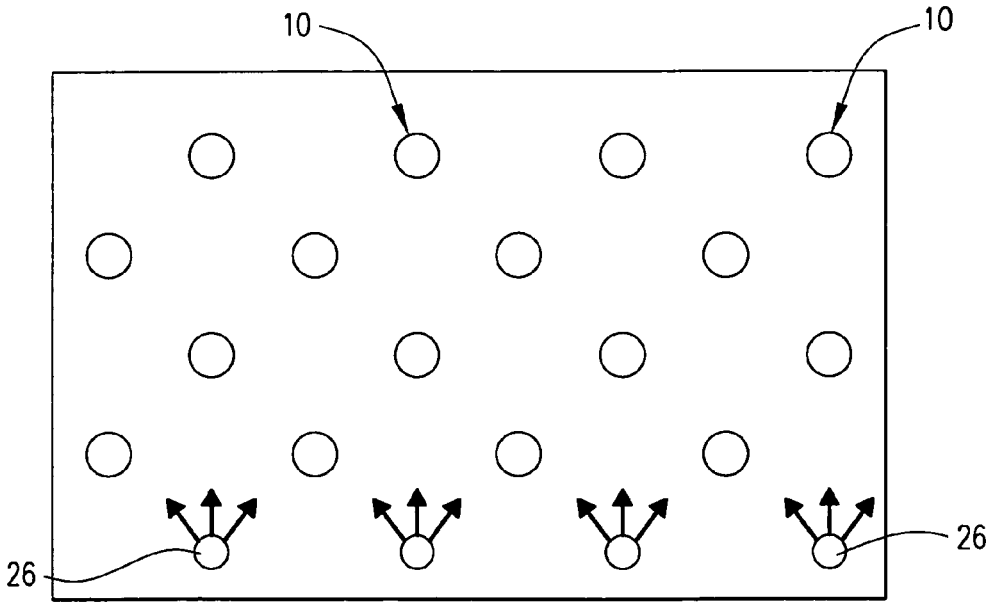
Figure 4D:
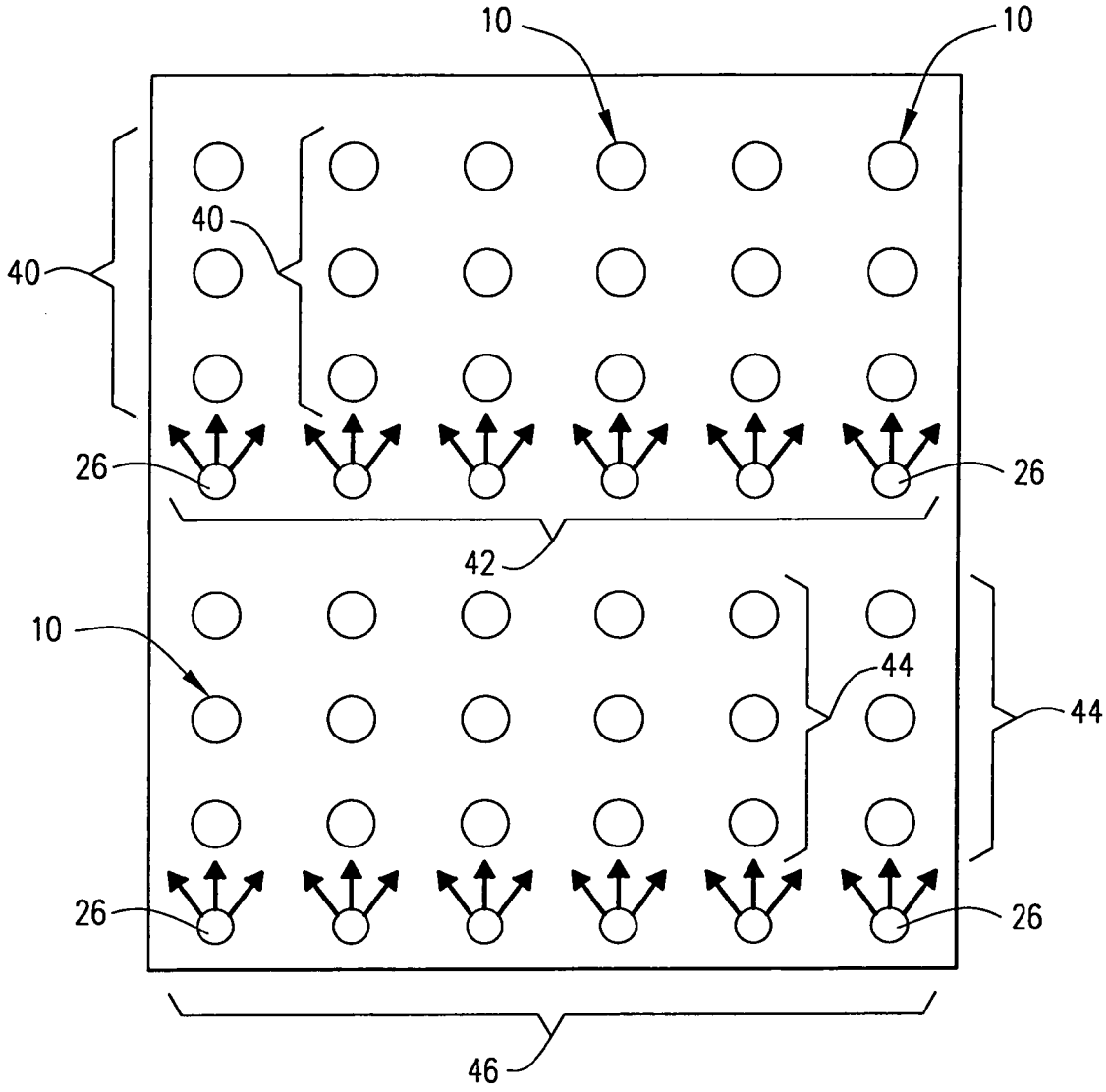

Additional examples of preferred patterns are illustrated in FIGS. 4A–4D. Rows of radiant wall burners 10 can be approximately parallel, the burners 10 can be approximately evenly spaced in columns 34 and the secondary fuel gas nozzles 26 can be positioned in a single row 32 with each nozzle directly below a radiant wall burner 10 in the row above as shown in FIG. 3, or offset as shown in FIG. 4A. As shown in FIG. 4B, in another preferred configuration, the radiant wall burners 10 are in columns approximately parallel, the radiant wall burners 10 are approximately evenly spaced in columns 34 and the secondary fuel gas nozzles 26 positioned below the radiant wall burners 10 are in two rows, an upper row 36 and a lower row 38, wherein each secondary fuel gas nozzle of the upper row 36 is below a burner in the row above and wherein each secondary fuel gas nozzle of the lower row 38 is midway between the horizontal positions of the secondary fuel gas nozzles directly above it in row 36. In yet another preferred configuration shown in FIG. 4C, the radiant wall burners 10 are offset halfway from one another, resulting in a diamond shaped pattern with the secondary fuel gas nozzles 26 located below the radiant wall burners and continuing the pattern. In still another preferred configuration, shown in FIG. 4D, about half of the radiant wall burners 10 are approximately evenly spaced in rows and columns 40 with a row 42 of secondary fuel gas nozzles 26 positioned directly below. The remaining radiant wall burners 10 are below row 42 of secondary fuel gas nozzles and arranged in columns 44. A second row 46 of secondary fuel gas nozzles 26 is located directly below the burner columns 44.

The furnace walls 31 with the radiant wall burners 10 and secondary fuel gas nozzles 26 connected thereto are described above as if the walls are vertical, but it is to be understood that the walls can be at an angle from vertical or the walls can be horizontal.

Figure 5B:
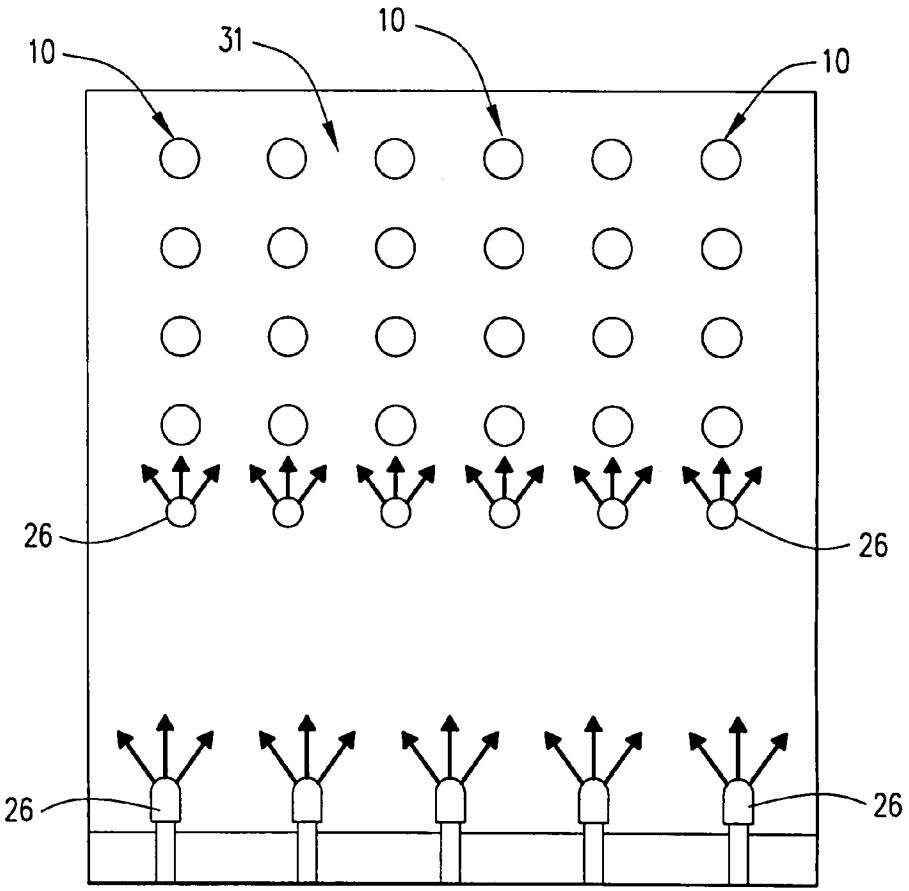
Figure 5A:
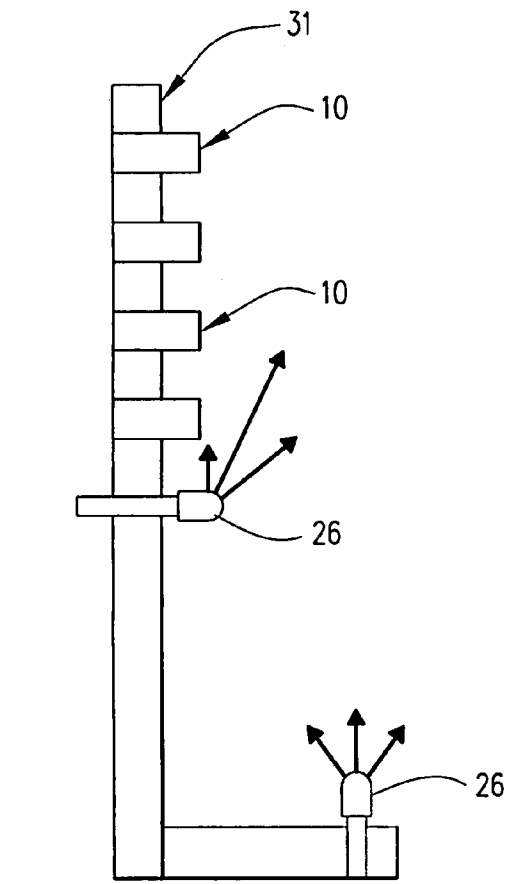

Referring now to FIGS. 5A–5F, alternate arrangements of secondary fuel gas nozzles 26 in accordance with the present invention are shown with and without floor burners 54 (also referred to as hearth burners). Referring to FIGS. 5A and 5B, rows of multiple radiant wall burners 10 are inserted in a wall 31 of a furnace. As previously mentioned, the burners 10 discharge fuel gas-air mixtures in directions across the face of the furnace wall 31. Each radiant wall burner is provided a mixture of primary fuel gas and air wherein the flow rate of air is greater than stoichiometry relative to the primary gas, i.e., in the range of from about 105% to about 120% of the stoichiometric flow rate. Secondary fuel gas is discharged into the furnace by way of secondary fuel gas nozzles 26 disposed below the columns of radiant gas burners 10. In addition, secondary fuel gas nozzles 26 are disposed in the floor of the furnace to provide additional secondary fuel gas that mixes with excess air and furnace fuel gases whereby low $NO_X$ levels are produced.

Figure 5E:
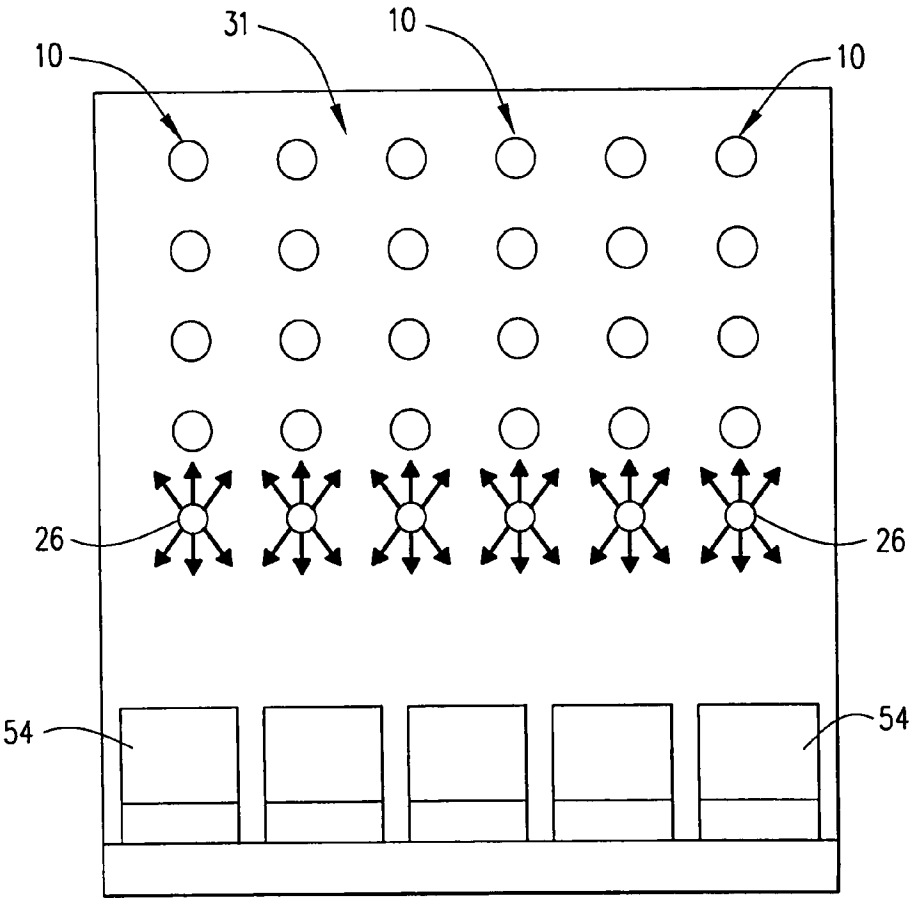
Figure 5F:
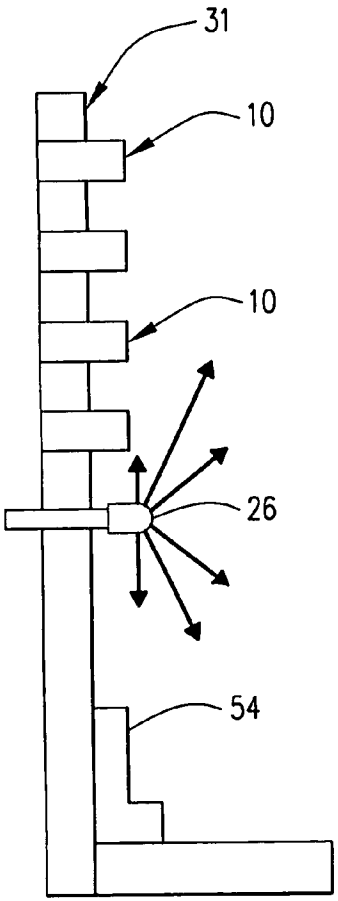
Figure 5E:
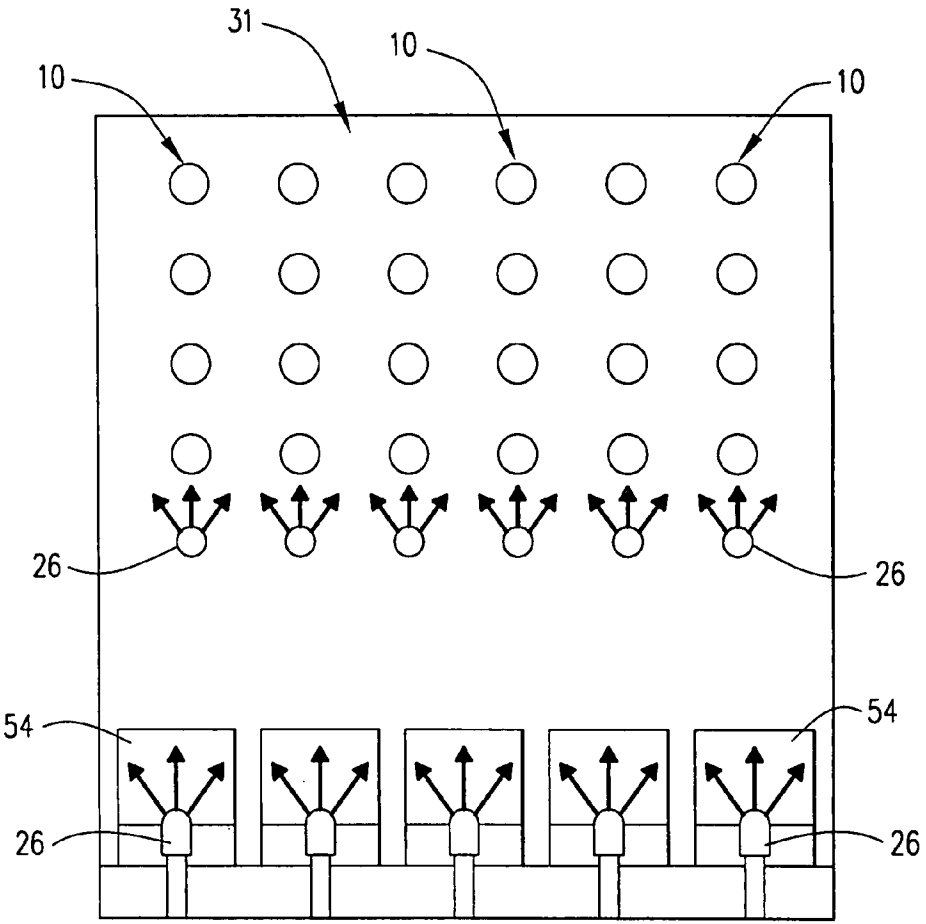
Figure 5F:
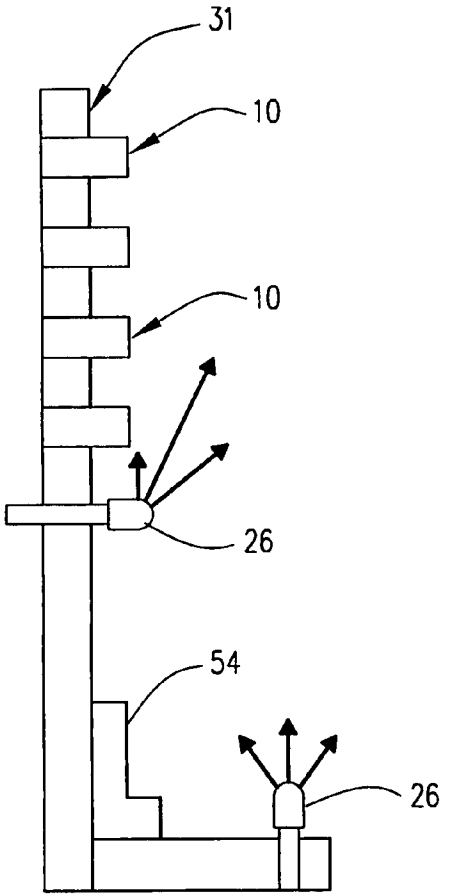
Figure 5B:
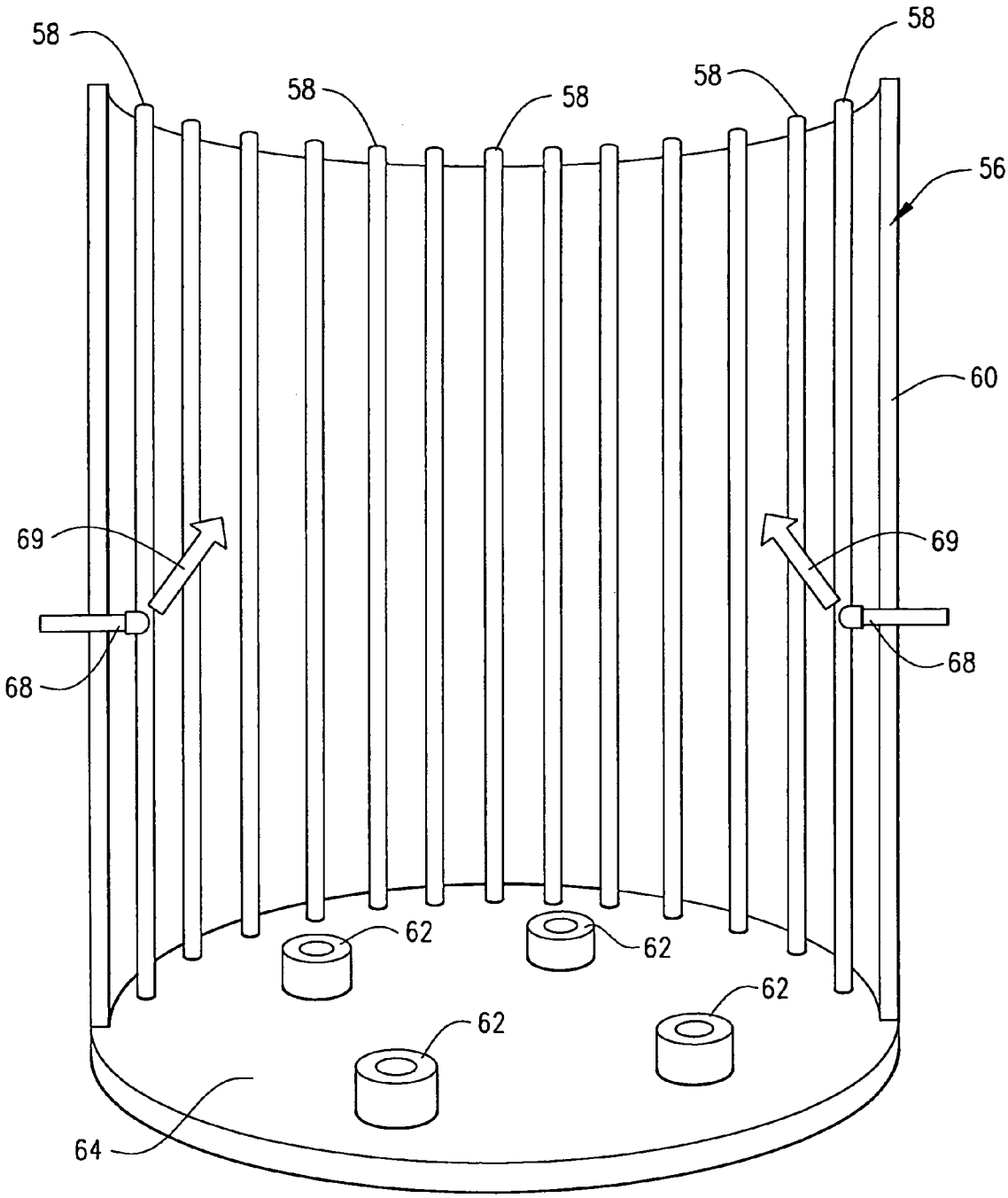
Figure 5C:
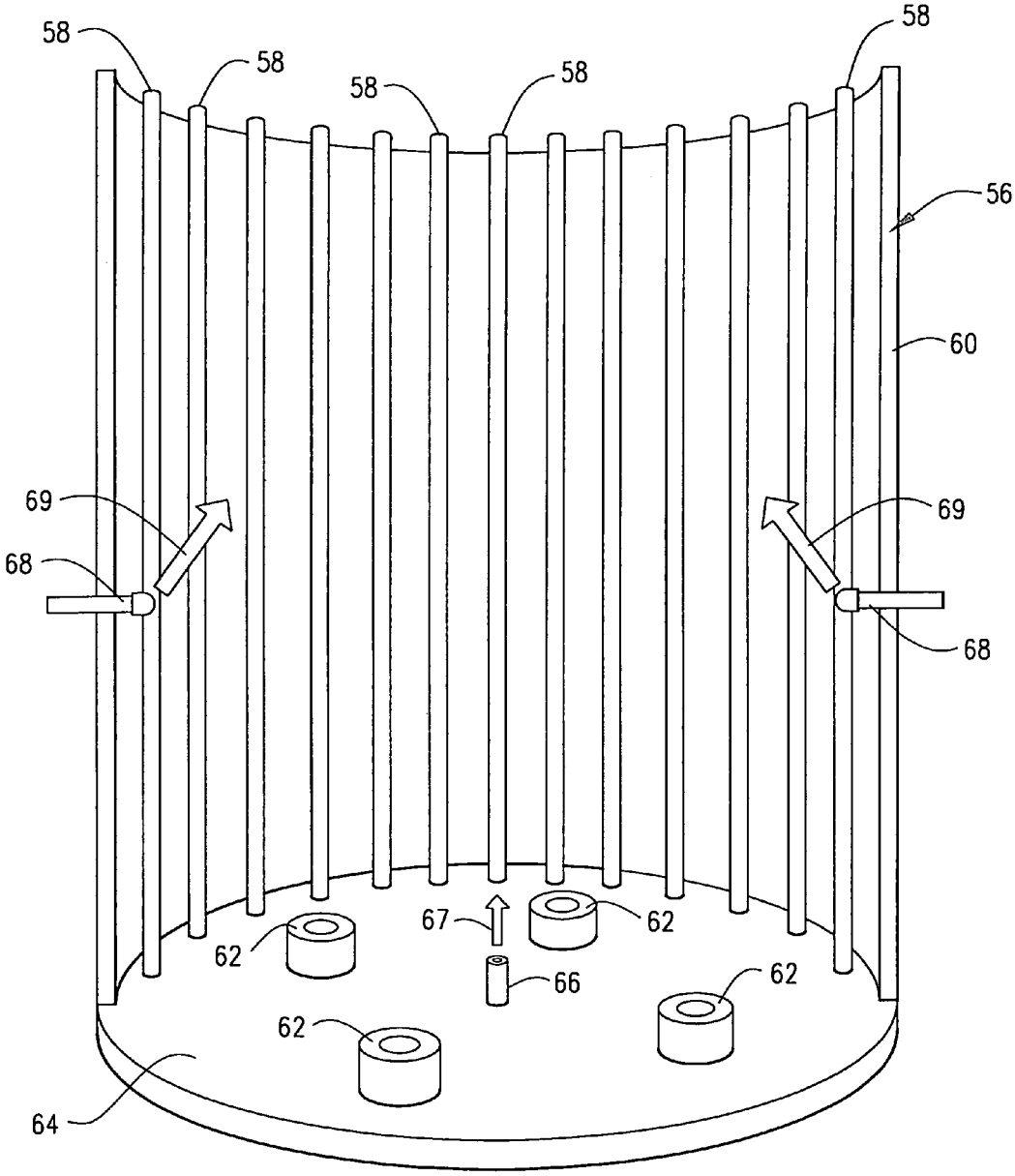

Referring now to FIGS. 5C and 5D, a similar arrangement of radiant wall burners 10 and secondary fuel gas nozzles 26 is illustrated. In addition, floor burners 54 are provided adjacent to the wall 31 that mix fuel gas with an excess of air, and the secondary fuel gas nozzles 26 discharge fuel gas toward both the radiant wall burners and the floor burners whereby the secondary fuel gas readily mixes with furnace fuel gases and excess air so that low $NO_X$ levels are produced.

Referring now to FIGS. 5E and 5F, instead of providing secondary fuel gas nozzles 26 that discharge fuel gas toward both the radiant wall burners and the floor burners, additional secondary fuel gas nozzles can be provided in the floor of the furnace to mix with furnace fuel gases and the excess air produced by the floor burners whereby low $NO_X$ levels are produced.

Thus, as will now be understood by those skilled in the art, a variety of combinations of radiant wall burners 10 and separate and remote secondary fuel gas nozzles can be utilized in radiant wall gas burner furnaces in accordance with this invention to reduce $NO_X$ levels in furnace fuel gases.

Any radiant wall burner can be used in the present inventive configurations and methods. Radiant wall burner designs and operation are well known to those skilled in the art. Examples of radiant wall burners which can be utilized include, but are not limited to, the wall burners described in U.S. Pat. No. 5,180,302 issued on Jan. 19, 1993 to Schwartz et al., and in U.S. patent application Ser. No. 09/949,007, filed Sep. 7, 2001 by Venizelos et al. and entitled "High Capacity/Low NOX Radiant Wall Burner," the disclosures of which are both incorporated herein by reference.

Figure 6A:
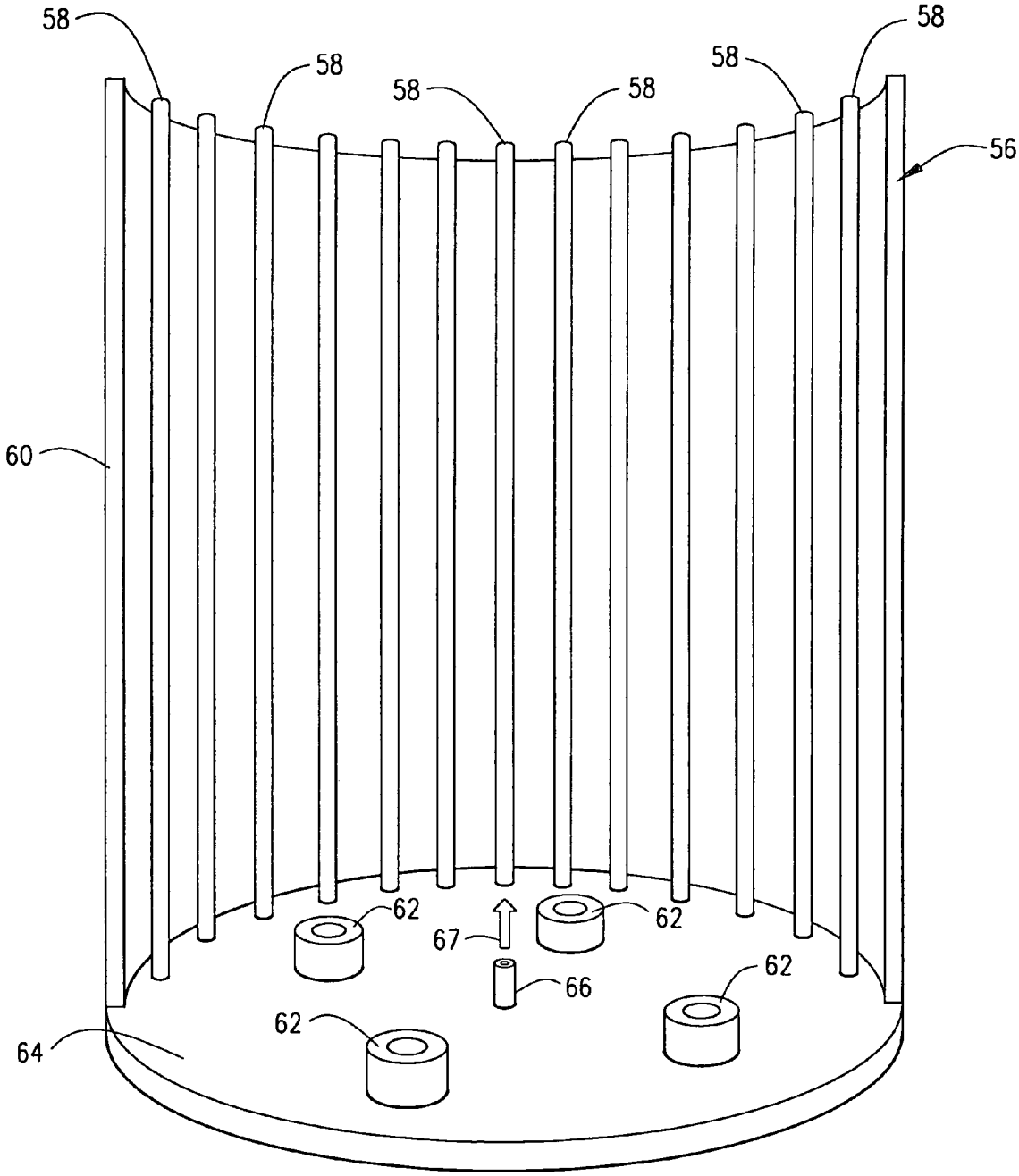

Referring now to FIGS. 6A, 6B and 6C, improved vertical cylindrical furnace burner configurations of this invention are illustrated. Referring to FIG. 6A, a vertical cylindrical furnace 56 is shown having vertical process tubes 58 disposed around and adjacent to the cylindrical wall 60 of the furnace. Four primary burners 62 are disposed on the floor 64 of the furnace, but as is understood by those skilled in the art, fewer or more burners 62 can be used. The burners 62 discharge and burn fuel gas lean-air mixtures vertically. As shown in FIG. 6A, a secondary fuel gas nozzle 66 is provided on the furnace floor positioned in a location separate and remote from the primary burners 62. When required, additional secondary fuel gas nozzles 66 can be provided on the furnace floor 64. As shown by the arrow 67, the secondary fuel gas is directed vertically by the secondary fuel gas nozzles 66 so that it mixes with fuel gases in the furnace and then combusts with excess air to thereby lower the temperature of the burning fuel gas and reduce the formation of $NO_X$.

In an alternate arrangement as shown in FIG. 6B, two secondary fuel gas nozzles 68 are provided attached to opposite sides of the cylindrical wall 60 of the furnace 56 above the burners 62. When required, only one or more than two secondary fuel gas nozzles 68 can be provided in the wall 60. As shown by the arrows 69, the secondary fuel gas is directed by the secondary fuel gas nozzles 68 at upward angles above the burners 62 whereby the secondary fuel gas mixes with fuel gases in the furnace and then combusts with excess air to thereby lower the temperature of the burning fuel gas and reduce the formation of $NO_X$.

As shown in FIG. 6C, both secondary fuel gas nozzles 66 and 68 can be utilized when required to reduce the formation of $NO_X$.

Figure 7A:
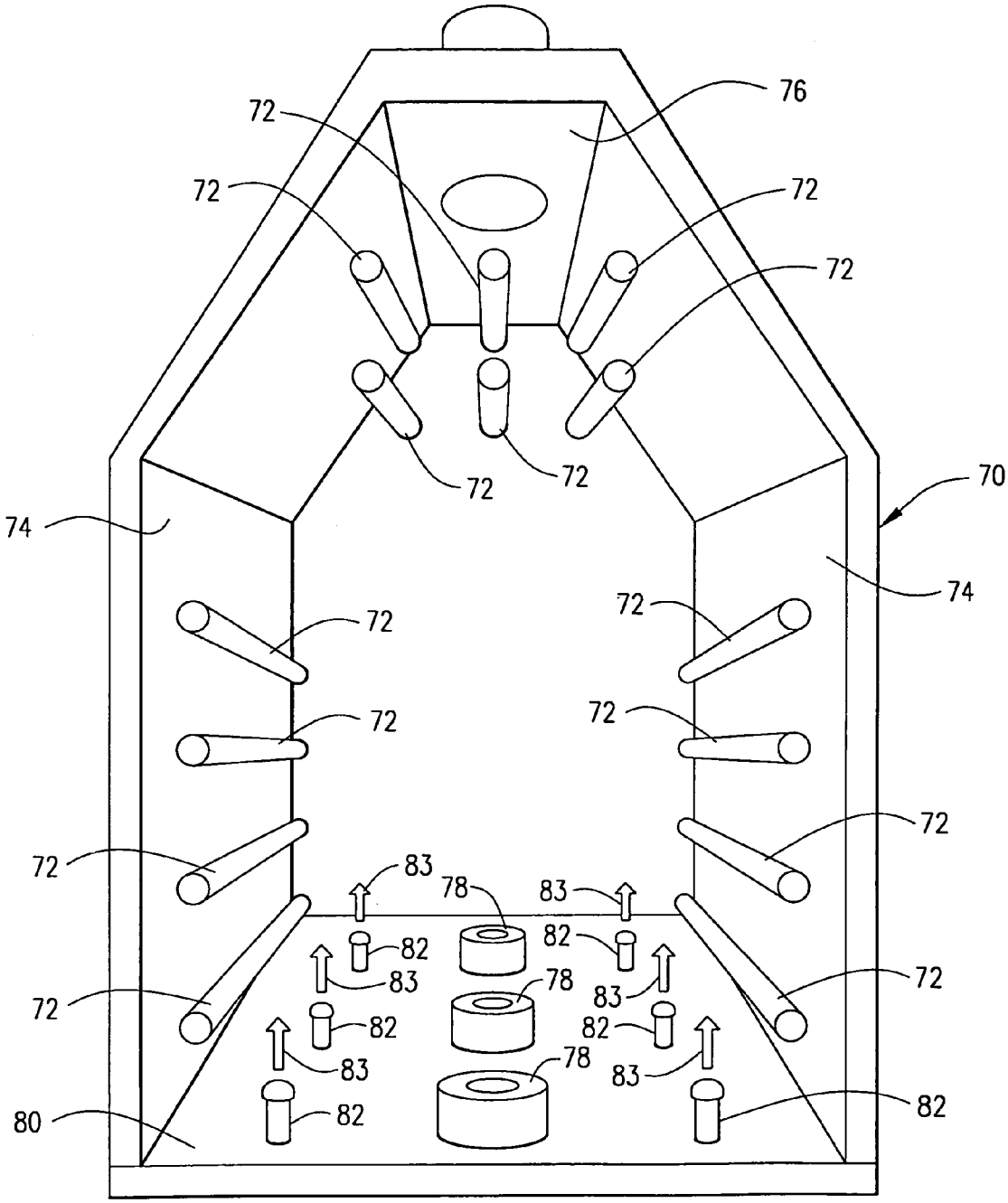
FIGS. 7A–7C illustrate preferred remote staging configurations in a cabin furnace.
Figure 7B:
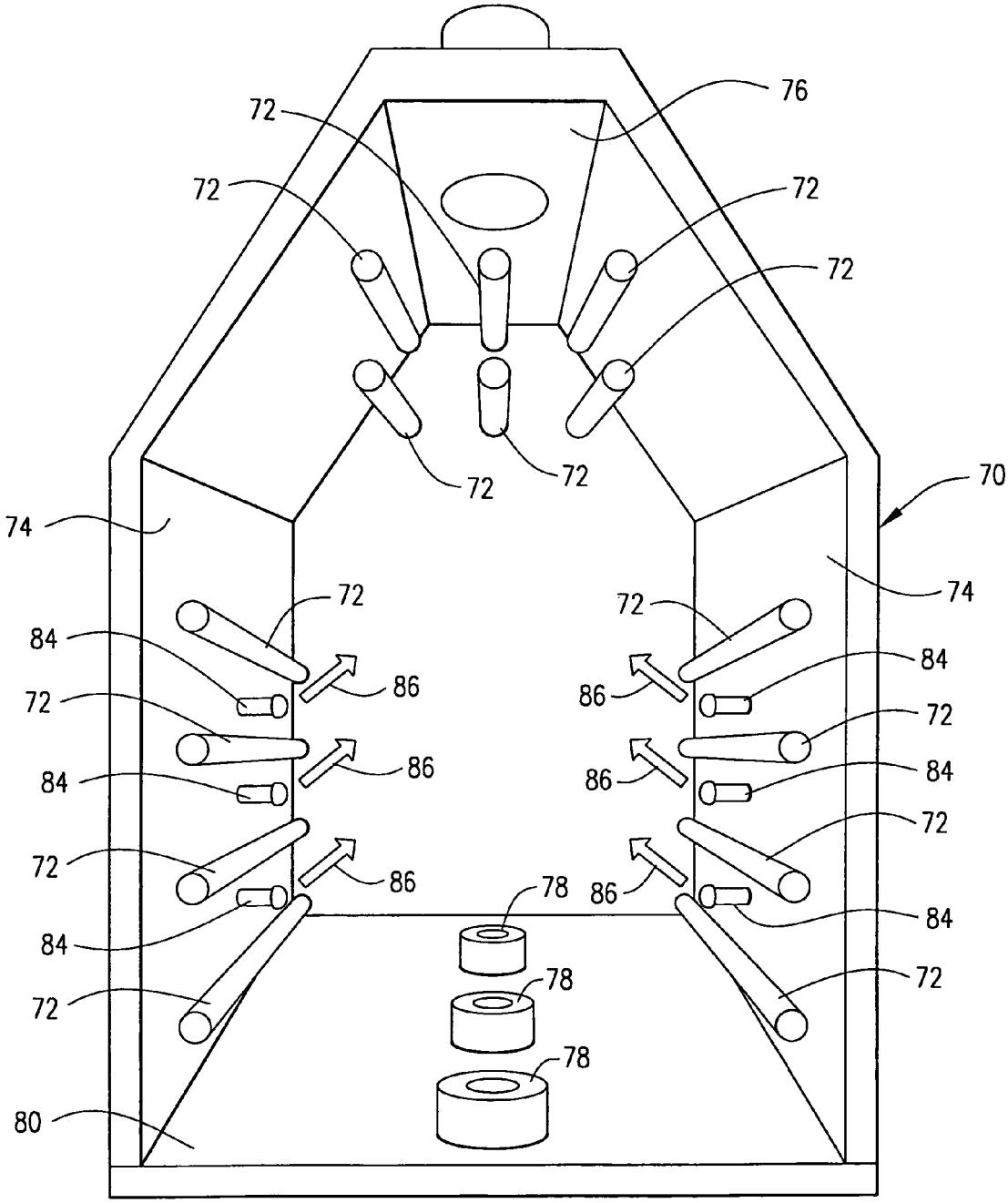
Figure 7C:
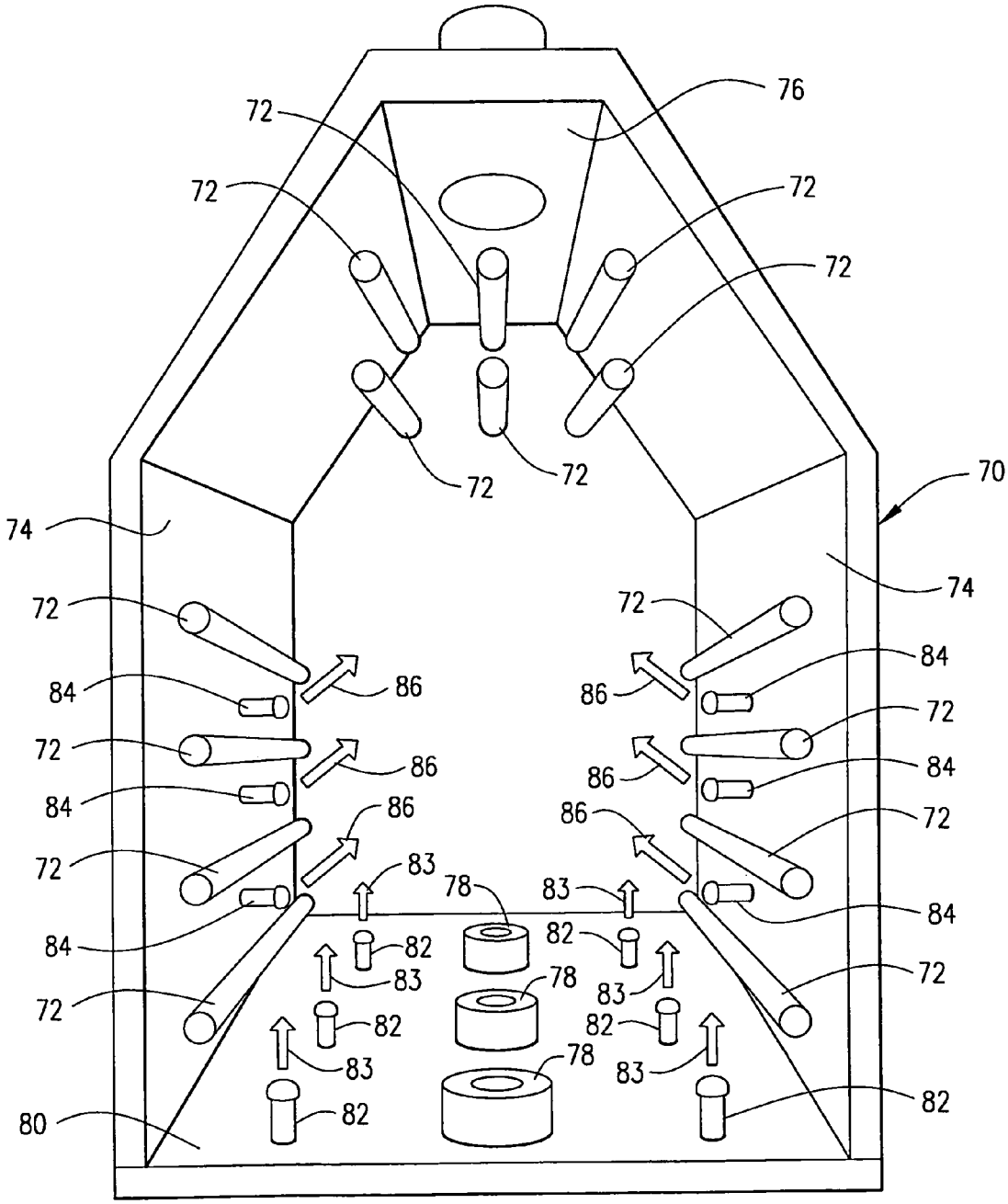

Referring now to FIGS. 7A, 7B and 7C, improved cabin and other similar furnace burner configurations of this invention are illustrated. Referring to FIG. 7A, a cabin furnace 70 is shown having horizontal process tubes 72 disposed on opposite sides 74 and the top 76. Three primary burners 78 are disposed on the floor 80 of the furnace, but fewer or more can be used. The burners 78 discharge and burn fuel gas lean-air mixtures vertically. As shown, secondary fuel gas nozzles 82 that direct secondary fuel gas vertically as shown by the arrows 83 are provided on the furnace floor on opposite sides of the burner 78. The secondary fuel gas mixes with fuel gases in the furnace and then combusts with excess air to thereby lower the temperature of the burning fuel gas and reduce the formation of $NO_X$.

In an alternate arrangement as shown in FIG. 7B, secondary fuel gas nozzles are omitted on the floor 80 of the furnace 70. Instead, secondary fuel gas nozzles 84 are provided on the opposite walls 74 between process tubes 72. As shown by the arrows 86, the secondary fuel gas is directed at upward angles above the burners 78 whereby the secondary fuel gas mixes with fuel gases in the furnace and then combusts with excess air to lower the temperature of the burning fuel gas and reduce the formation of $NO_X$.

As shown in FIG. 7C, both secondary fuel gas nozzles 82 and 84 can be utilized when required to reduce the formation of $NO_X$.

While different furnace types have been described herein, it will be understood by those skilled in the art that the furnace burner configurations of this invention can be utilized in any combustion furnace to reduce $NO_X$ formation.

Preferably, the total fuel gas-air mixture flowing through the furnace burners contains less than about 80% of the total fuel supplied to the combustion zone 28.

The secondary fuel gas nozzles are disposed on the furnace floor or walls extending about 1 to about 12 inches into the furnace interior. Fuel gas is preferably supplied at a pressure in the range of from about 20 to about 50 psig.

Figure 8:
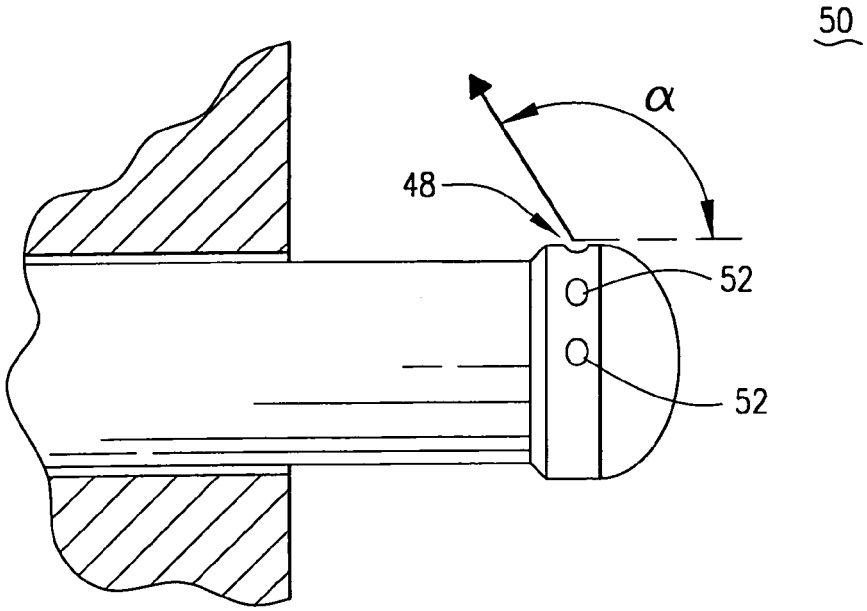
FIG. 8 is a side view of a preferred secondary fuel gas discharge nozzle for use in accordance with this invention.
Figure 9:
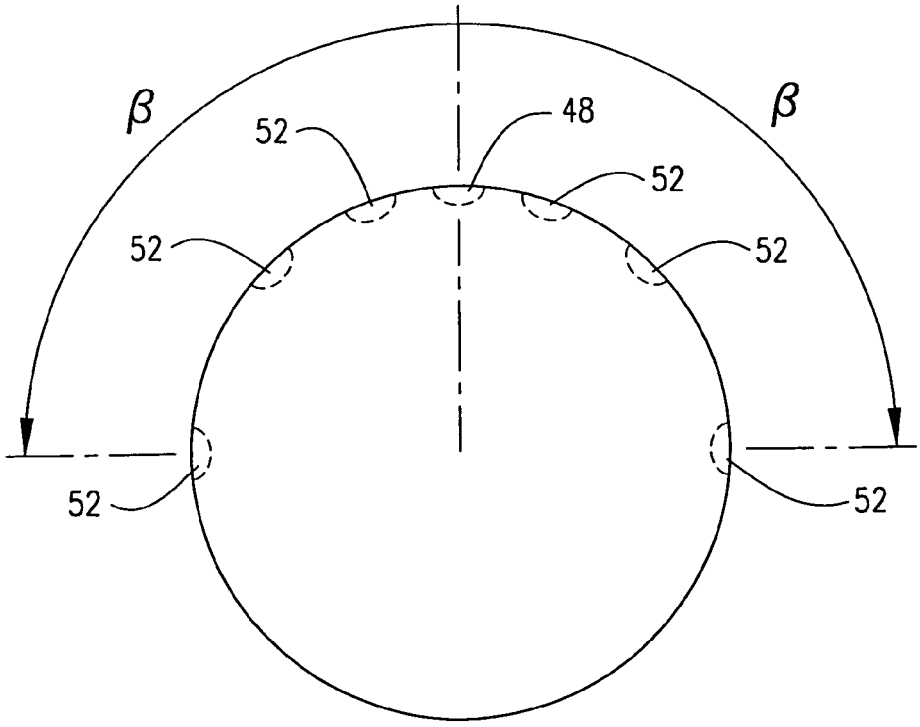
FIG. 9 is a top view of the secondary fuel gas discharge nozzle of FIG. 8.
Figure 10:
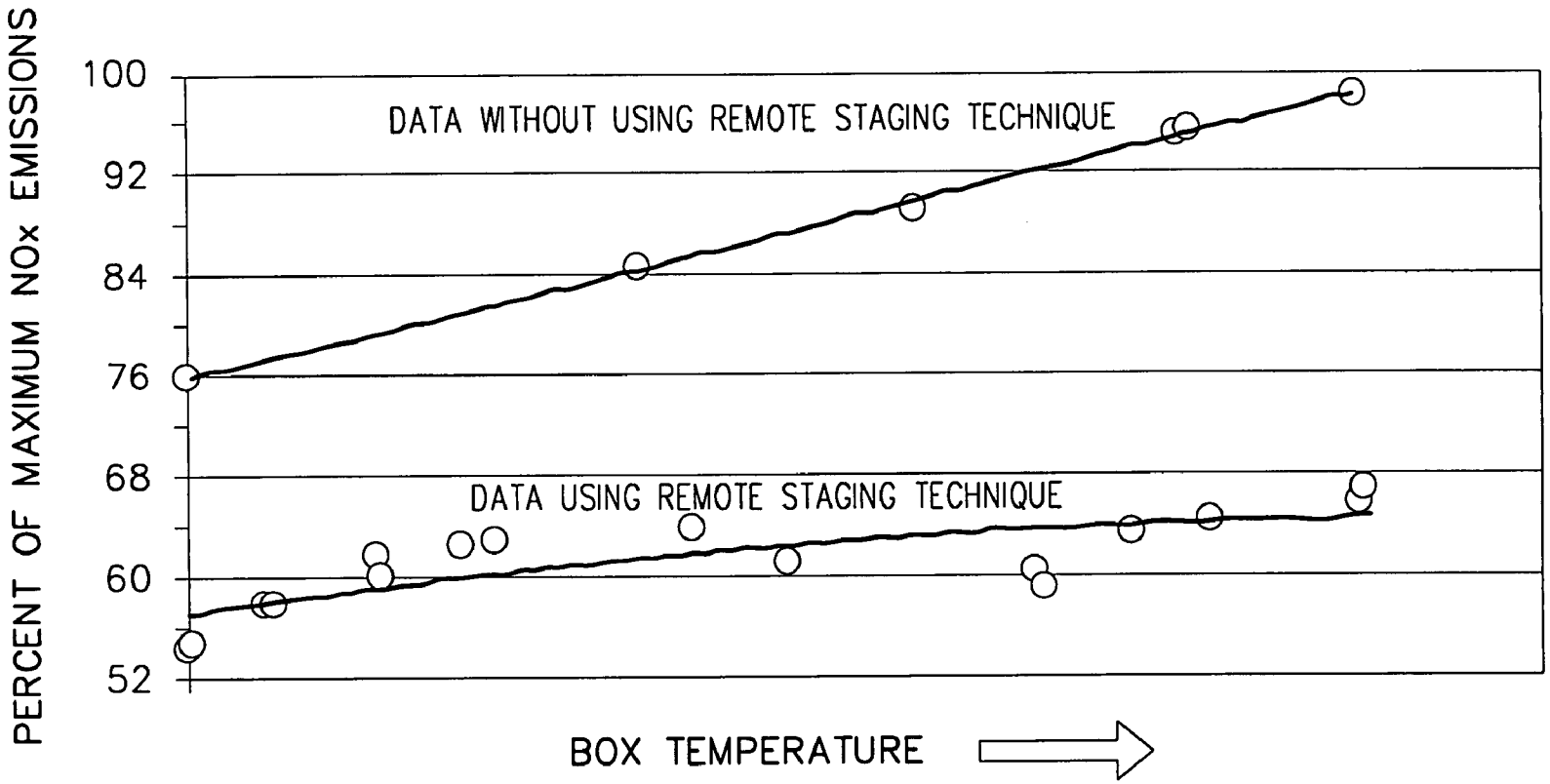
FIG. 10 is a graph comparing $NO_X$ emissions from a test furnace with and without the remote staging technique of this invention.

The secondary fuel gas nozzles positioned on the walls of furnaces and illustrated in FIGS. 1 through 5 are shown in detail in FIGS. 8 and 9. The nozzles can have single fuel gas delivery openings 48 therein for discharging the flow of secondary fuel gas into the furnace. The openings 48 discharge secondary fuel gas towards or away from a wall of a furnace at an angle $\alpha$ in the general range of about 60° to about 120° from the longitudinal axis. The secondary fuel gas nozzles can also include additional side delivery openings 52 for discharging secondary fuel gas in various directions over angles $\beta$ in the range of from about 10° to about 180° from both sides of a vertical plane through the longitudinal axis, and more preferably at angles in the range of about 20° to about 150°.

When the secondary fuel gas nozzles are positioned on the walls or floors of vertical cylindrical furnaces, cabin furnaces and other similar furnaces, they can include fuel gas delivery openings therein that discharge secondary fuel gas in multiple directions.

A low $NO_X$ producing furnace of the present invention having walls and a floor comprises:

one or an array of burners on a wall or the floor of the furnace that introduce a combustible fuel gas lean-air mixture into a combustion zone adjacent to the burner or burners; and one or one or more arrays of secondary fuel gas nozzles located separate and remote from the burner or burners that introduce secondary fuel gas into the furnace whereby the secondary fuel gas mixes with fuel gases in the furnace, combusts with excess air, lowers the temperature of the burning fuel gas and reduces the formation of $NO_X$.

A method of the present invention for burning fuel gas and air in a furnace whereby fuel gases of reduced $NO_X$ content are formed comprises the following steps:

(a) providing a fuel gas lean-air mixture to one or an array of burners disposed on a wall or the floor of the furnace;

(b) causing the fuel gas lean-air mixture to be discharged from the burner or burners whereby the mixture is burned at a relatively low temperature and fuel gases having low $NO_X$ content are formed therefrom; and (c) providing secondary fuel gas to one or one or more arrays of separate and remote secondary fuel gas nozzles located whereby the secondary fuel gas is discharged from the secondary fuel gas nozzles, mixes with fuel gases in the furnace, combusts with excess air from the burners, lowers the temperature of the burning fuel gas and reduces the formation of $NO_X$.

In order to further illustrate the furnace burner configuration and method of the present invention, the following example is given.

EXAMPLE

A comparison was made of the $NO_X$ emissions using radiant wall burners with and without remote staging. The test furnace utilized an array of 12 radiant wall burners arranged in 3 columns of 4 burners each. The burners were spaced 50 inches apart in each column and the columns were spaced 36.5 inches apart. The furnace was operated while supplying secondary gas to the center of the radiant wall burners and the $NO_X$ in the furnace off gas was measured over time. The furnace was then operated after removing secondary gas from the burner centers and conducting the secondary gas to remote nozzles located adjacent to the columns of radiant wall burners.

FIG. 8 is a plot comparing $NO_X$ emissions from the furnace with and without the remote staging configuration. The data demonstrate that $NO_X$ emissions are reduced by 50% using the remote staging configuration.

Thus, the present invention is well adapted to attain the objects and advantages mentioned as well as those that are inherent therein. While numerous changes may be made by those skilled in the art, such changes are encompassed within the spirit of this invention as defined by the appended claims.

What is claimed is:

1. A low $NO_X$ producing furnace having walls and a floor comprising:

a burner on a wall or the floor of the furnace for introducing a lean combustible fuel gas-air mixture into a combustion zone adjacent to the burner; and a secondary fuel gas nozzle for introducing secondary fuel gas into the furnace that mixes with fuel gases in the furnace and combusts with excess air, lowers the temperature of the burning fuel gas and reduces the formation of $NO_X$, said secondary fuel gas nozzle being located separate and remote from said burner such that the secondary fuel gas is not encapsulated or surrounded by the fuel gas-air mixture from the burner thereby allowing secondary fuel gas to mix with fuel gases in the furnace prior to the mixing with the fuel gas-air mixture.

2. The low $NO_X$ producing furnace of claim 1 wherein the secondary fuel gas nozzle is positioned on a walls or the floor of the furnace.

3. The low $NO_X$ producing furnace of claim 1 wherein the secondary fuel gas nozzle direct secondary fuel gas to a location in the furnace on the opposite side of the combustion zone from the burner.

4. The low $NO_X$ producing furnace of claim 1 wherein the furnace contains an array of burners in at least one row or column and one or an array of secondary fuel gas nozzles.

5. The low $NO_X$ producing furnace of claim 4 wherein the burners are disposed in an array on the floor of the furnace and the secondary fuel gas is discharged from one or an array of secondary fuel gas nozzles on the floor of the furnace.

6. The low $NO_X$ producing furnace of claim 1 wherein the burners are disposed in an array on the floor of the furnace and the secondary fuel gas is discharged from one or an array of secondary fuel gas nozzles on the walls of the furnace.

7. The low $NO_X$ producing furnace of claim 1 wherein the burners are disposed in an array on the floor of the furnace and the secondary fuel gas is discharged from one or an array of secondary fuel gas nozzles on the floor of the furnace and from one or an array of secondary fuel gas nozzles on the walls of the furnace.

8. The low $NO_X$ producing furnace of claim 1 wherein the secondary fuel gas nozzle has at least one fuel delivery opening therein that discharges secondary fuel gas toward or away from the floor or walls of the furnace.

9. The low $NO_X$ producing furnace of claim 1 wherein the secondary fuel gas nozzle has multiple fuel delivery openings positioned to discharge fuel gas toward or away from the floor or walls of the furnace, or both.

10. The low $NO_X$ producing furnace of claim 1 wherein the furnace is a radiant wall furnace.

11. The low $NO_X$ producing furnace of claim 1 wherein the furnace is a vertical cylindrical furnace.

12. The low $NO_X$ producing furnace of claim 1 wherein the furnace is a cabin furnace, a boiler or other similar furnace.

13. A method of burning fuel gas and air in a furnace whereby fuel gases of reduced $NO_X$ content are formed comprising the steps of:

(a) providing a lean fuel gas-air mixture to a burner disposed on a wall or the floor of the furnace;

(b) causing the fuel gas-air mixture to be discharged from the burner whereby the mixture is burned at a relatively low temperature in a combustion zone and fuel gases having low $NO_X$ content are formed therefrom; and (c) providing secondary fuel gas to a secondary fuel gas nozzle whereby the secondary fuel gas is discharged from the secondary fuel gas nozzle, mixes with fuel gases in the furnace and combusts with excess air from the burner, lowers the temperature of the burning fuel gas and reduces the formation of $NO_X$said secondary fuel gas nozzle being located separate and remote from the burner such that the secondary fuel gas is not encapsulated or surrounded by the mixture of fuel gas and air from the burner thereby allowing secondary fuel gas to mix with fuel gases in the furnace prior to mixing with the mixture of fuel gas and air from the burner.

14. The method of claim 13 wherein the secondary fuel gas nozzle discharges secondary fuel gas to a location in the furnace on the opposite side of the combustion zone from the burner.

15. The method of claim 13 wherein the furnace includes a plurality of burners disposed in an array on the floor of the furnace and the secondary fuel gas is discharged from one or an array of secondary fuel gas nozzles on the floor of the furnace.

16. The method of claim 13 wherein the furnace includes a plurality of burners disposed in an array on the floor of the furnace and the secondary fuel gas is discharged from one or an array of secondary fuel gas nozzles on the walls of the furnace.

17. The method of claim 13 wherein the furnace includes a plurality of burners disposed in an array on the floor of the furnace and the secondary fuel gas is discharged from one or an array of secondary fuel gas nozzles on the floor of the furnace and from one or an array of secondary fuel gas nozzles on the walls of the furnace.

18. The method of claim 13 wherein the secondary fuel gas nozzle has at least one fuel delivery opening therein to discharge secondary fuel gas toward or away from a wall or walls of the furnace.

19. The method of claim 13 wherein the secondary fuel gas nozzle has multiple fuel delivery openings positioned to discharge fuel gas toward or away from the furnace wall, or both.

20. The method of claim 13 wherein the furnace is a radiant wall furnace.

21. The method of claim 13 wherein the furnace is a vertical cylindrical furnace.

22. The method of claim 13 wherein the furnace is a cabin furnace, a boiler or other similar furnace.

* * * * *

UNITED STATES PATENT AND TRADEMARK OFFICE

CERTIFICATE OF CORRECTION

PATENT NO. : 7,153,129 B2
APPLICATION NO. : 10/807977
DATED : December 26, 2006
INVENTOR(S) : Wesley R. Bussman et al.

It is certified that error appears in the above-identified patent and that said Letters Patent is hereby corrected as shown below:

Abstract,
Line 4, delete "fuel" and substitute -- flue -- therefor.

Column 1,
Line 61, delete "fuel" and substitute -- flue -- therefor.

Column 2,
Line 8, delete "fuel" and substitute -- flue -- therefor.

Column 3,
Line 1, delete "fuel" and substitute -- flue -- therefor.
Line 14, delete "fuel" and substitute -- flue -- therefor.

Column 4,
Line 17, delete "fuel" and substitute -- flue -- therefor.
Line 26, delete "fuel" and substitute -- flue -- therefor.

Column 5,
Line 42, delete "fuel" and substitute -- flue -- therefor.
Line 50, delete "fuel" and substitute -- flue -- therefor.
Line 56, delete "fuel" and substitute -- flue -- therefor.
Line 63, delete "fuel" and substitute -- flue -- therefor.

Column 6,
Line 23, delete "fuel" and substitute -- flue -- therefor.
Line 35, delete "fuel" and substitute -- flue -- therefor.
Line 52, delete "fuel" and substitute -- flue -- therefor.
Line 62, delete "fuel" and substitute -- flue -- therefor.

Column 7,
Line 40, delete "fuel" and substitute -- flue -- therefor.
Line 45, delete "fuel" and substitute -- flue -- therefor.
Line 51, delete "fuel" and substitute -- flue -- therefor.
Line 57, delete "fuel" and substitute -- flue -- therefor.

Column 8,
Line 35, delete "fuel" and substitute -- flue -- therefor.
Line 39, delete "walls" and substitute -- wall -- therefor.

UNITED STATES PATENT AND TRADEMARK OFFICE

CERTIFICATE OF CORRECTION

PATENT NO. : 7,153,129 B2
APPLICATION NO. : 10/807977
DATED : December 26, 2006
INVENTOR(S) : Wesley R. Bussman et al.

It is certified that error appears in the above-identified patent and that said Letters Patent is hereby corrected as shown below:

Column 9,
Line 11, delete "fuel" and substitute -- flue -- therefor.
Line 17, delete "fuel" and substitute -- flue -- therefor.
Line 21, delete "fuel" and substitute -- flue -- therefor.
Line 24, delete "$NO_x$said" and substitute --$NO_x$, said -- therefor.
Line 29, delete "fuel" and substitute -- flue -- therefor.

Signed and Sealed this

Thirteenth Day of March, 2007

JON W. DUDAS
*Director of the United States Patent and Trademark Office*